US007309952B2

(12) United States Patent
Choo et al.

(10) Patent No.: US 7,309,952 B2
(45) Date of Patent: Dec. 18, 2007

(54) FLAT PANEL WITH BLEND ROUND PORTION STRUCTURE FOR USE IN A CATHODE RAY TUBE

(75) Inventors: Kyoung Mun Choo, Kyungki-do (KR); Soon Woong Lee, Kyungki-do (KR); Jae Seon Kim, Kyungki-do (KR)

(73) Assignee: Samsung Corning Co., Ltd., Kyungki-do (KR)

( * ) Notice: Subject to any disclaimer, the term of this patent is extended or adjusted under 35 U.S.C. 154(b) by 102 days.

(21) Appl. No.: 10/926,076

(22) Filed: Aug. 26, 2004

(65) Prior Publication Data

US 2005/0046329 A1 Mar. 3, 2005

(30) Foreign Application Priority Data

Aug. 29, 2003 (KR) ..... 10-2003-0060422
Aug. 17, 2004 (KR) ..... 10-2004-0064796

(51) Int. Cl.
*H01J 29/86* (2006.01)
*H01J 29/92* (2006.01)

(52) U.S. Cl. ..... 313/477 R; 313/493; 313/634

(58) Field of Classification Search ..... 313/477 R, 313/493, 634

See application file for complete search history.

(56) References Cited

U.S. PATENT DOCUMENTS 5,568,011 A * 10/1996 Ragland et al. ..... 313/477 R
5,925,977 A * 7/1999 Sugawara et al. ..... 313/477 R
6,509,683 B2 * 1/2003 Lee ..... 313/477 R
6,577,055 B1 * 6/2003 Sugawara et al. ..... 313/477 R
6,667,570 B2 * 12/2003 Kim et al. ..... 313/477 R
6,765,344 B2 * 7/2004 Yoshida et al. ..... 313/477 R
7,005,791 B2 * 2/2006 Choo et al. ..... 313/477 R

FOREIGN PATENT DOCUMENTS

JP 54-162449 12/1979
JP 2000-357476 12/2000
JP 2001-216919 8/2001

* cited by examiner

*Primary Examiner*—Nimeshkumar D. Patel
*Assistant Examiner*—Kevin Quarterman
(74) *Attorney, Agent, or Firm*—Bacon & Thomas, PLLC

(57) ABSTRACT

A flat panel for a cathode ray tube includes a faceplate portion, a skirt portion and a blend round portion joining the faceplate portion with the skirt portion. A point where an external contour of the faceplate portion meets an external blend round contour of the blend round portion is defined as a first point and a point where an external contour of the skirt portion meets the external blend round contour is defined as a second point. The external blend round contour is formed between an imaginary arc whose end points coincide with the first and second points and a line segment whose end points coincide with the first and second points, or is the line segment. The imaginary arc is smoothly connected to the external contours of the faceplate portion and the skirt portion at the first and the second point.

7 Claims, 6 Drawing Sheets

FLAT PANEL WITH BLEND ROUND PORTION STRUCTURE FOR USE IN A CATHODE RAY TUBE

FIELD OF THE INVENTION

The present invention relates to a flat panel for use in a cathode ray tube; and, more particularly, to a flat panel whose weight is reduced by improving the shape of a blend round portion thereof.

BACKGROUND OF THE INVENTION

As well known, a glass bulb employed in a cathode ray tube for use in color television sets, computer monitors, or the like basically includes three parts, namely a panel for displaying images, a conic funnel joined to a rear portion of the panel and a cylindrical neck joined to an apex portion of the conic funnel. The panel, the funnel and the neck are made of glass, and particularly the panel and the funnel are formed by press-forming a charge of molten glass called a glass gob into predetermined sizes and shapes. After press-formed, the panel is subjected to a pin sealing process for sealing stud pins, an annealing process performed in an annealing lehr for removing residual stress from the panel by heat-treatment, a lapping process and an inspection process in order, so that a finished panel product is obtained.

Referring to FIG. 1, there is shown a configuration of a glass bulb 10 for use in a cathode ray tube. A panel 20 of the glass bulb 10 includes a faceplate portion 21 for displaying images, a skirt portion 23 extending backward from the perimeter of the faceplate portion 21 and having a seal edge 22 on its back end, and a blend round portion 24 for joining the skirt portion 23 to the faceplate portion 21. The inner surface of the faceplate portion 21 is coated with a fluorescent material for forming images thereon. The blend round portion 24 is also called as a fillet referring to a smoothly curved corner portion connecting the contours of faceplate portion 21 and the skirt portion 23.

A funnel 30 has a body portion 32, which is provided with a seal edge 31 connected to the seal edge 22 of the panel 20, and a yoke portion 33 extending backward from the body portion 32. Further, a neck 40 is connected to the yoke portion 33 of the funnel 30.

Recently, an increasing number of active researches are in progress to reduce the thickness and the weight of the panel, to thereby cut costs in manufacturing the panel for use in the cathode ray tube.

Conventionally, in order to reduce the weight of the panel, the faceplate portion has been designed to have a reduced thickness or the skirt portion has been configured to have a reduced height. However, there has been reported no method for changing the shape of the blend round portion for the purpose of realizing the weight reduction of the panel.

SUMMARY OF THE INVENTION

It is, therefore, an object of the present invention to provide a flat panel for use in a cathode ray tube, which has a blend round portion which is capable of reducing a gross weight of the panel while, at the same time, satisfying the IEC (International Electrotechnical Commission) standard for implosion resistance and guaranteeing formability in press-forming.

In accordance with the present invention, there is provided a flat panel for use in a cathode ray tube, including: a faceplate portion for displaying images; a skirt portion extended backward from a perimeter of the faceplate portion; and a blend round portion joining the faceplate portion with the skirt portion, wherein, looking at a cross section of the panel, a point formed by an external contour of the faceplate portion and an external blend round contour of the blend round portion is defined as a first point and a point formed by an external contour of the skirt portion and the external blend round contour of the blend round portion is defined as a second point, wherein the external blend round contour is formed between an imaginary arc whose two opposite end points coincide with the first and the second point, respectively and a line segment whose two opposite end points coincide with the first and the second point, respectively, or is the line segment whose two opposite end points coincide with the first and the second point, and wherein the imaginary arc is smoothly connected to the external contours of the faceplate portion and the skirt portion at the first and the second point, respectively.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 2:
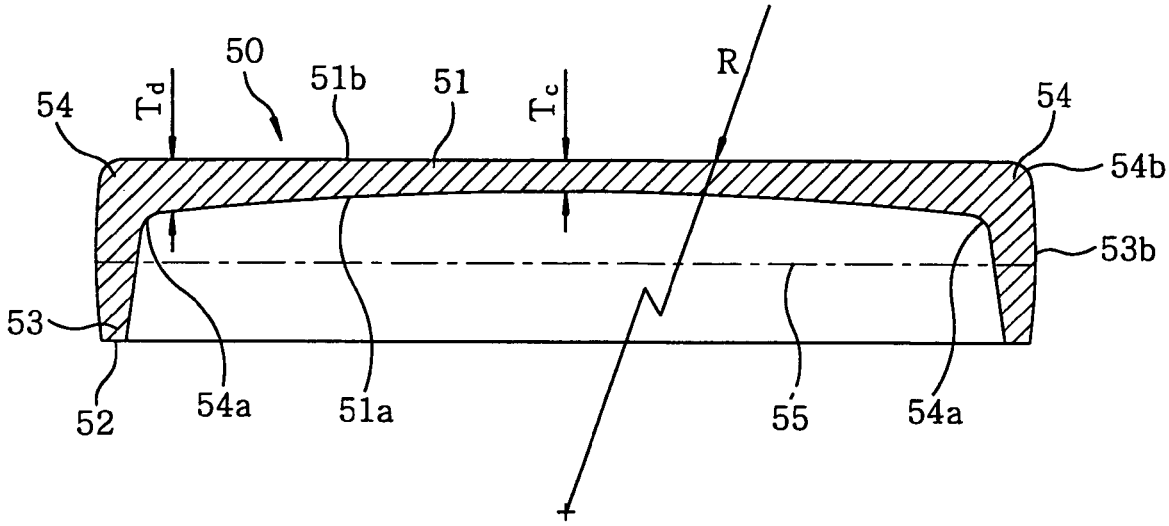
FIG. 2 provides a cross sectional view of a flat panel for use in a cathode ray tube in accordance with the present invention.

Referring to FIG. 2, there is shown a cross sectional view of a flat panel 50 for use in a cathode ray tube in accordance with the present invention. The flat panel 50 has a faceplate portion 51 for displaying images, the inner surface of the faceplate portion 51 being coated with a fluorescent material for forming images thereon; a skirt portion 53 extending backward from the perimeter of the faceplate portion 51 and having a seal edge 52 at its end; and a blend round portion 54 joining the faceplate portion 51 with the skirt portion 53. Further, a mold match line 55, which is a flash made by a parting line between a bottom mold and a middle mold, is formed on the outer surface of the skirt portion 53 of the flat panel 50.

Figure 3:
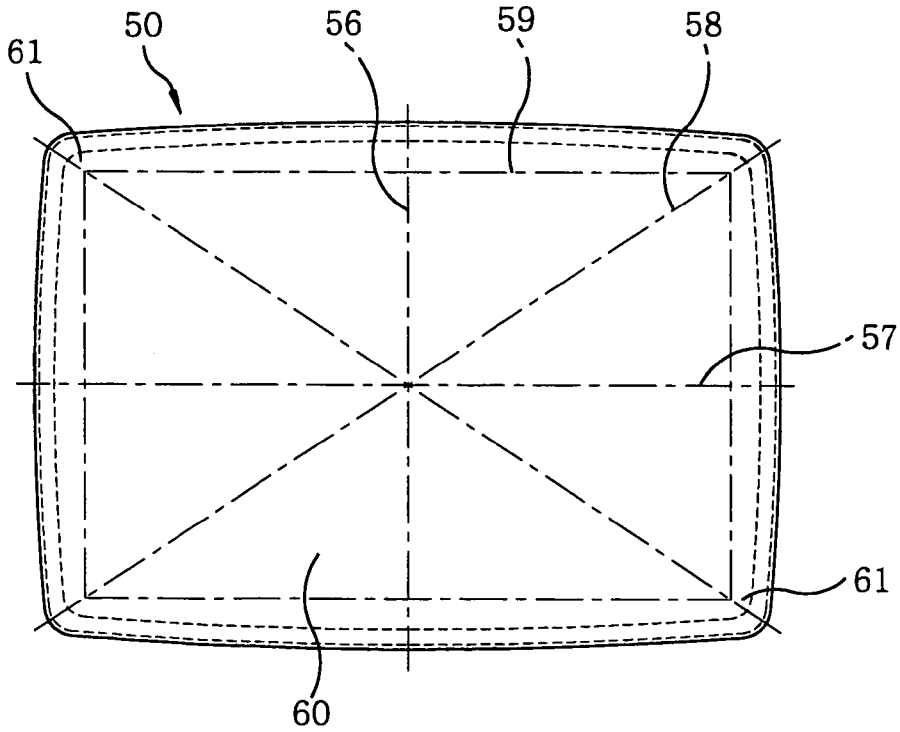
FIG. 3 presents a top view of a flat panel for use in a cathode ray tube in accordance with the present invention.

As shown in FIG. 3, the flat panel 50 is of a substantially rectangular shape having a shorter axis 56, a longer axis 57 and diagonal axes 58. The faceplate portion 51 is divided into a central portion 60 serving as a useful screen (or effective picture plane) 59 for displaying images thereon and a peripheral portion 61 surrounding the central portion 60.

Figure 1:
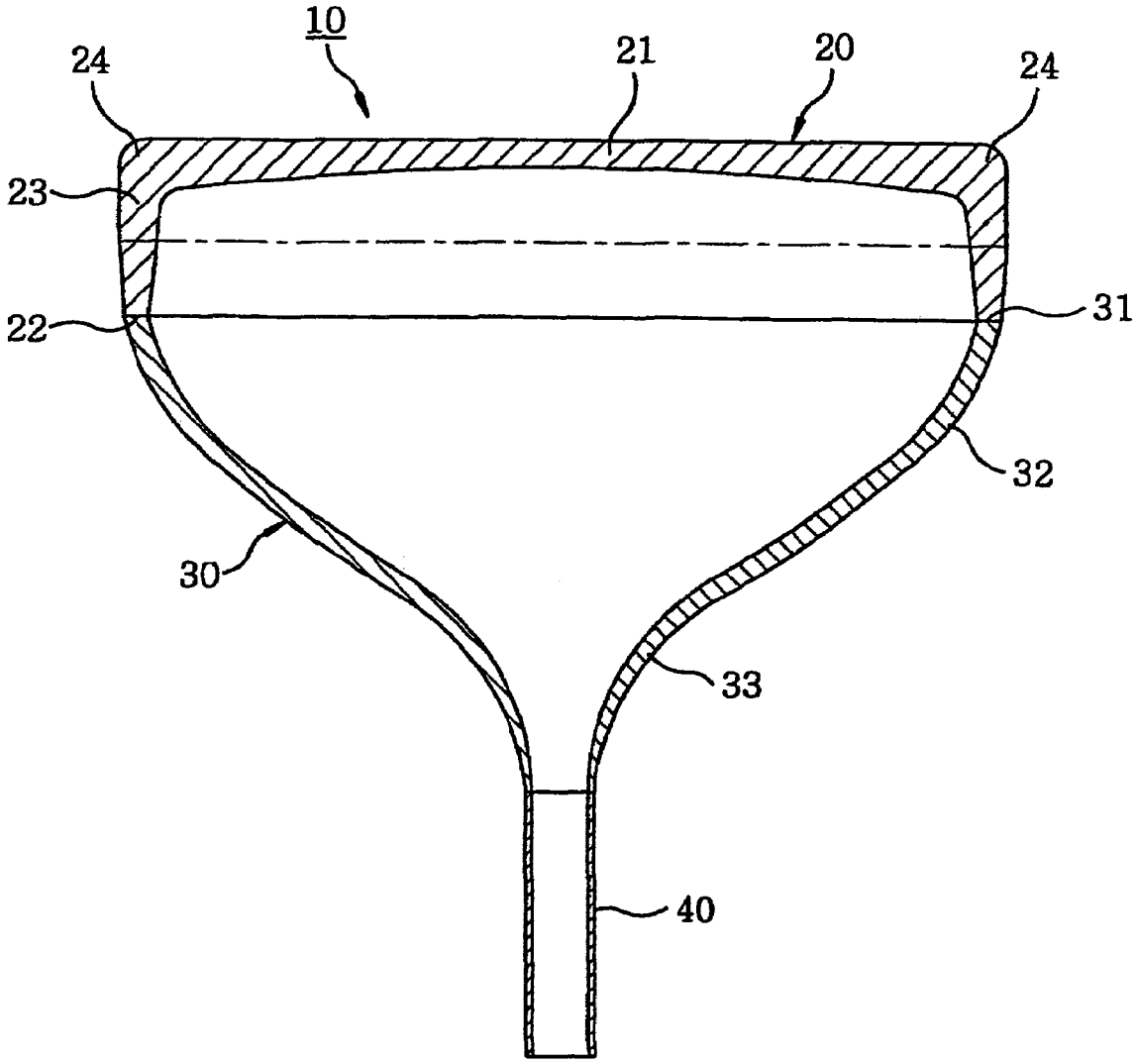
FIG. 1 (PRIOR ART)
FIG. 1 is a cross sectional view showing a configuration of a general glass bulb for use in a cathode ray tube.
Figure 4:
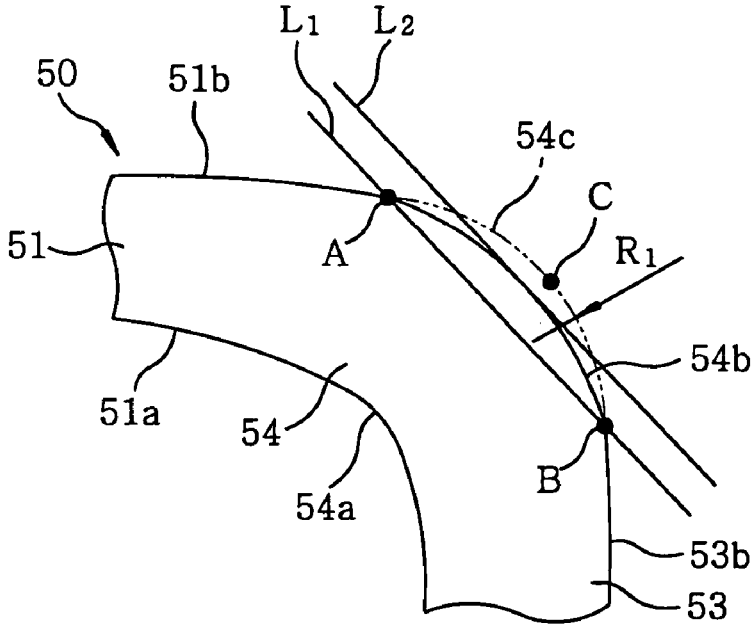
FIG. 4 illustrates a drawing describing a method for forming an external blend round contour of a blend round portion of a flat panel for use in a cathode ray tube in accordance with a first preferred embodiment of the present invention.

Referring to FIGS. 2 and 3, reference characters Tc represent a thickness of the flat panel 50 measured at the center of the faceplate portion 51, i.e., a center face thickness (mm). Reference characters Td represent a diagonal face thickness of useful screen (mm), namely, a thickness of the flat panel 50 measured at a tangent point where an internal contour 51*a* of the faceplate portion 51 and an internal blend round contour 54*a* of the blend round portion 54 tangentially meet. And the flat panel 50 is thickest at the tangent point in the peripheral portion 61 of the faceplate portion 51. The flat panel 50 for use in a cathode ray tube and a method for the manufacture thereof will now be described with reference to FIG. 4. First, an imaginary round contour 54*c* for obtaining an external blend round contour 54*b* of the blend round portion 54 joining the faceplate portion 51 with the skirt portion 53 of the flat panel 50 is obtained. Herein, the radius of curvature $R_1$ of the imaginary round contour (or imaginary arc) 54*c* can be obtained by the same method as employed to obtain the radius of curvature of an external blend round contour of the conventional blend round portion 24 shown in FIG. 1. In case of flat panels for use in cathode ray tubes of 17 to 32 inch, the radius of curvature of the external blend round contour of the conventional blend round portion 24 typically ranges from 8 to 15 mm, though it differs depending on the types of the cathode ray tubes. Further, a characteristic value of a conic section (described later) for a round line having the radius of curvature of 8 to 15 mm is about 0.419 to 0.429.

Next, a first point A where an external contour 51*b* of the faceplate portion 51 meets the imaginary round contour 54*c* and a second point B where an external contour 53*b* of the skirt portion 53 meets the imaginary round contour 54*c* are obtained. The first point A does not go into the useful screen 59 and the second point B does not go beyond the mold match line 55 from the blend round portion 54. Further, the imaginary round contour 54*c* is smoothly connected to the external contour 51*b* of the faceplate portion 51 and the external contour 53*b* of the skirt portion 53. That is to say, a graph formed by the external contour 51*b* of the faceplate portion 51, the imaginary round contour 54*c* and the external contour 53*b* of the skirt portion 53 has differential values at the first and the second point A and B. Then, a first straight line $L_1$ connecting the first and the second point A and B is drawn, and a second straight line $L_2$ having the same gradient as that of the straight line $L_1$ is then obtained. At this time, the second straight line $L_2$ locates between the first straight line $L_1$ and the apex C of the imaginary round contour 54*c*. Once the second straight line $L_2$ is obtained, the blend round portion 54, which has the external blend round contour 54*b* which connects the first and the second point A and B and is tangent to the second straight line $L_2$, is formed.

Figure 5:
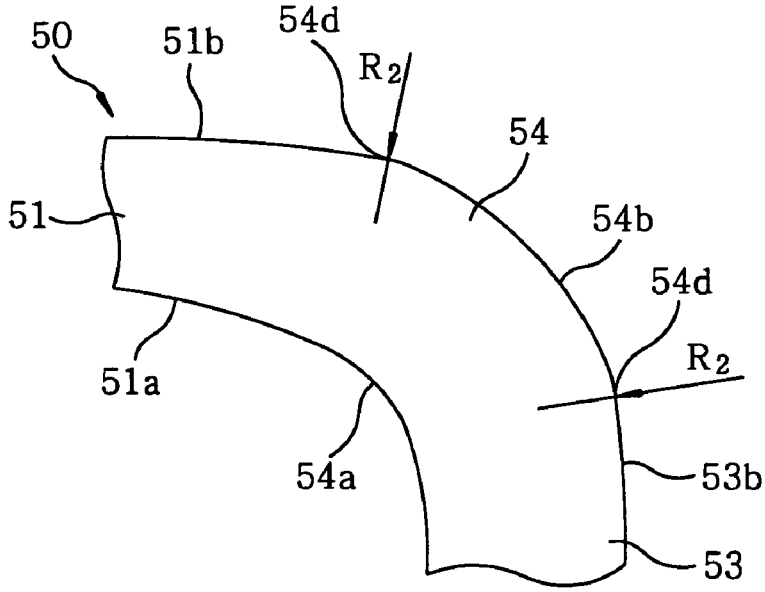
FIG. 5 offers a partial cross sectional view of the flat panel for use in the cathode ray tube in accordance with the first preferred embodiment of the present invention.

Furthermore, as shown in FIG. 5, edge portions at the first and the second point A and B are preferably rounded to become rounds 54*d* each of which has the radius of curvature $R_2$ (mm) preferably satisfying the following equation:

$$R_2 \geqq 1 \qquad \text{Eq. 1}$$

The rounds 54*d* having such radius of curvature $R_2$ allow the external contour 51*b* of the faceplate portion 51 and the external contour 53*b* of the skirt portion 53 to be smoothly connected to the external blend round contour 54*b*, thereby contributing to the formability of press-forming and avoiding breakage, such as cracks, due to the concentration of stress.

Figure 6:
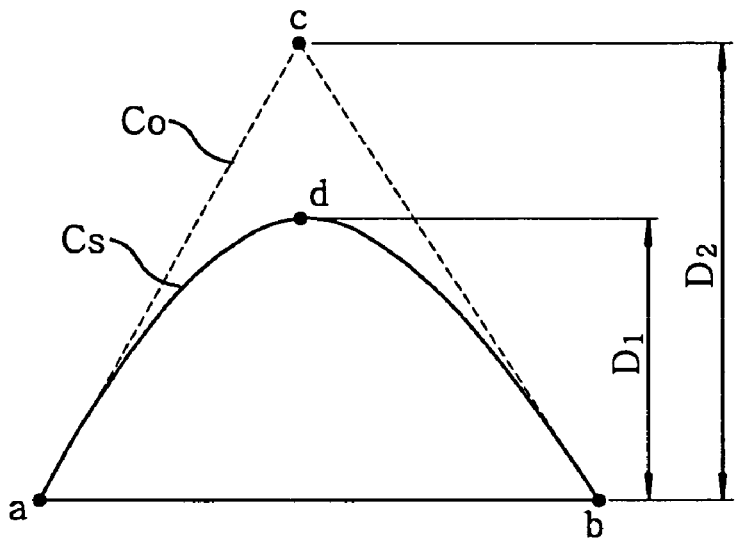
FIG. 6 sets forth a drawing describing characteristic values of a conic section.

As shown in FIG. 6, the characteristic value (rho; ρ) of a conic section Cs, any one of circles, ellipses, parabolas and hyperbolas, can be obtained by the following equation:

$$\rho = D_1/D_2 \qquad \text{Eq. 2}$$

wherein $D_1$ represents a distance between the base a-b of a cone Co and the apex d of the conic section Cs; and $D_2$ represents a distance between the base a-b of the cone Co and the top c of the cone Co. Further, oblique sides a-c and b-c of the cone Co are parts of tangent lines that are tangent to the conic section Cs at points a and b, respectively.

Especially, the characteristic value of an arc can be expressed as follows:

$$\rho = \cos(\theta/2)/(1+\cos(\theta/2)) \qquad \text{Eq. 3}$$

wherein θ represents a central angle corresponding to the arc, namely, an angle formed by a straight line connecting a start point of the arc and a center of a circle including the arc and another straight line connecting an end point of the arc and the center of the circle.

With regard to the flat panel 50 in accordance with the present invention, it is preferred to design the external blend round contour 54*b* of the blend round portion 54 for connecting the faceplate portion 51 and the skirt portion 53 to become a conic section having a characteristic value (ρ) as follows:

$$0.44 \leqq \rho \leqq 0.5 \qquad \text{Eq. 4}$$

If the characteristic value (ρ) of the conic section for the external blend round contour 54*b* is smaller than a minimum value of 0.44, the effect of reducing the weight of the panel is very low. That is, the rate of weight reduction is less than 0.9%. Meanwhile, if the characteristic value (ρ) of the conic section for the external blend round contour 54*b* is greater than a maximum value of 0.5, the external blend round contour 54*b* becomes a concave curve rendering the first and the second point A and B sharpened, thereby increasing the probability of breakage of the flat panel 50 when the flat panel 50 is transferred or when an implosion-proof band (not shown) is installed around the skirt portion 53, while deteriorating the implosion resistance due to the concentration of vacuum stress. Moreover, if the characteristic value of the conic section for the external blend round contour 54*b* is equal to 0.5, the contour 54*b* becomes almost straight.

Experiments were conducted in order to illustrate the weight reduction rates of panels in accordance with the first preferred embodiment of the present invention, and Table 1 shows results of the experiments. In Table 1, panels of comparative examples 1 to 8 were conventional panels of 17 to 32 inch having the same configurations as those of the panels in accordance with the present invention except the configuration of the blend round portion 54 shown in FIGS. 2 and 3. The panels of examples 1 to 8, based on the panels of the comparative examples 1 to 8, were manufactured to satisfy the equations 1 to 4, respectively. In Table 1, the weight of each panel were obtained by actual measurement, and the weight reduction rates represent decrement percentages of the weights of the panels of the examples 1 to 8 to the weights of the corresponding panels of the comparative examples 1 to 8, respectively.

TABLE 1

| Classification | Type of CRT | Characteristic Value of Conic Section (ρ) Longer Axis | Shorter Axis | Diagonal Axis | Weight (g) | Weight Decrement Percentage (%) |
|---|---|---|---|---|---|---|
| Comparative Example 1 | 17" | 0.428 | 0.429 | 0.429 | 6549.4 | — |
| Comparative Example 2 | 19" A | 0.428 | 0.428 | 0.428 | 8965.0 | — |
| Comparative Example 3 | 19" B | 0.428 | 0.429 | 0.429 | 8841.1 | — |
| Comparative Example 4 | 21" | 0.419 | 0.419 | 0.421 | 11643.8 | — |
| Comparative Example 5 | 25" | 0.425 | 0.425 | 0.426 | 14463.7 | — |
| Comparative Example 6 | 28" | 0.423 | 0.423 | 0.425 | 17321.7 | — |
| Comparative Example 7 | 29" | 0.425 | 0.425 | 0.425 | 21880.8 | — |
| Comparative Example 8 | 32" | 0.425 | 0.425 | 0.425 | 26625.4 | — |
| Example 1 | 17" | 0.499 | 0.499 | 0.499 | 6413.0 | 2.1 |
| Example 2 | 19" A | 0.499 | 0.499 | 0.499 | 8807.2 | 1.7 |
| Example 3 | 19" B | 0.499 | 0.499 | 0.499 | 8704.0 | 1.5 |
| Example 4 | 21" | 0.499 | 0.499 | 0.499 | 11442.9 | 1.7 |
| Example 5 | 25" | 0.499 | 0.499 | 0.499 | 14339.4 | 0.9 |
| Example 6 | 28" | 0.499 | 0.499 | 0.499 | 17174.0 | 0.9 |
| Example 7 | 29" | 0.499 | 0.499 | 0.499 | 21611.8 | 1.2 |
| Example 8 | 32" | 0.499 | 0.499 | 0.499 | 26231.9 | 1.5 |

As indicated in Table 1, in each of the comparative examples 1 to 8, a characteristic value ρ of a conic section for an external blend round contour is found to be less than 0.44 with respect to a shorter axis, a longer axis and a diagonal axis, respectively. Further, each of the panels of 17 to 32 inch of the examples 1 to 8 is fabricated such that their characteristic values (ρ) of conic sections for external blend round contours are 0.499. In comparison with the weights of the panels of the comparative examples 1 to 8, the weights of the panels of the examples 1 to 8 are reduced by 0.9 to 2.1%. Furthermore, the respective panels of 17 to 32 inch of the examples 1 to 8 each of which has an external blend round contour for which the characteristic value of conic section ranges from 0.44 to 0.5 satisfies the IEC (international Electrotechnical Commission) standard for the implosion resistance and guarantees the formability of press-forming.

Figure 7:
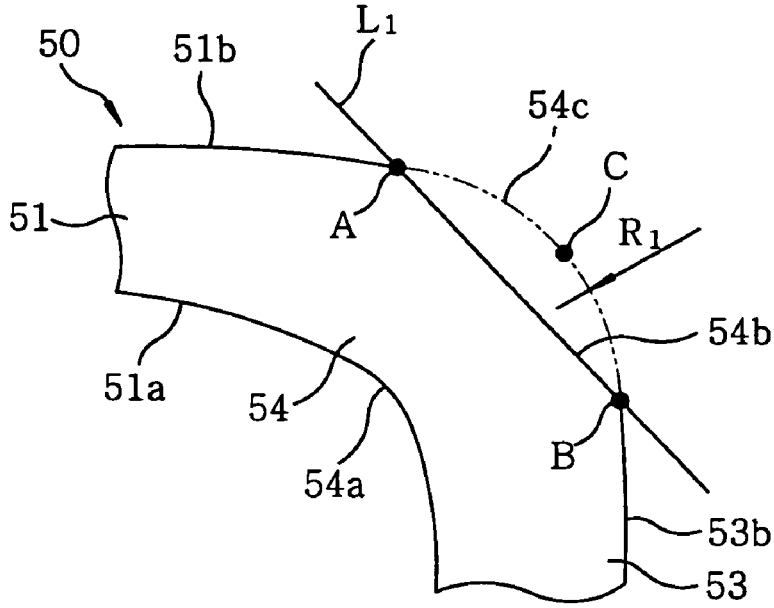
FIG. 7 shows a drawing describing a method for forming an external blend round contour of a blend round portion of a flat panel for use in a cathode ray tube in accordance with a second preferred embodiment of the present invention.
Figure 8:
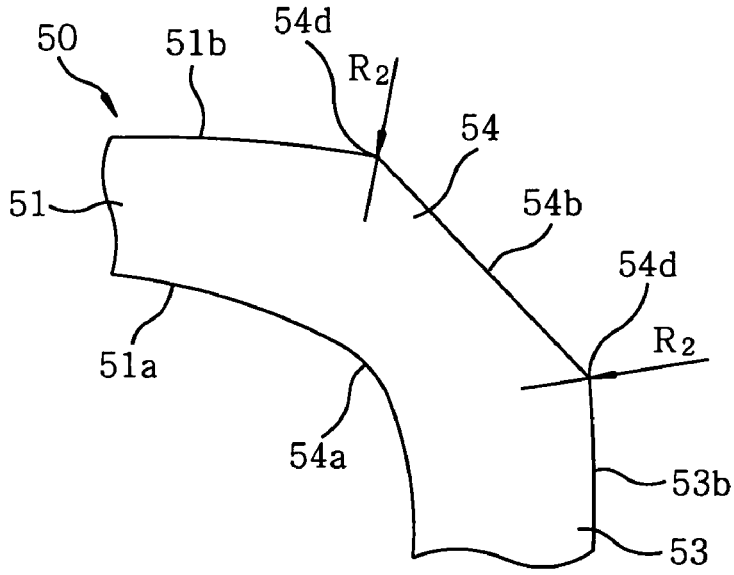
FIG. 8 presents a partial cross sectional view of the flat panel for use in the cathode ray tube in accordance with the second preferred embodiment of the present invention.

Referring to FIGS. 7 and 8, a flat panel 50 for use in a cathode ray tube in accordance with a second preferred embodiment of the present invention and a manufacturing method thereof will be described hereinafter. First, as in the first embodiment, the first and the second point A and B and the first straight line $L_1$ connecting them are obtained. A line segment between the first and the second point A and B among the first straight line $L_1$, i.e., a line segment AB forms the external blend round contour 54*b* of a blend round portion 54. That is to say, thus obtained external blend round contour 54*b* has a shape similar to that obtained by chamfering a conventional blend round portion.

Further, as in the first embodiment, edge portions at the first and the second point A and B are rounded to become rounds 54*d* each having a radius of curvature equal to or greater than 1 mm, as shown in FIG. 8.

Moreover, the external blend round contour 54*b* may be a line segment between two points where the second straight line $L_2$ (see FIG. 4) and an imaginary round contour 54*c* (see FIG. 4) meet.

Figure 9:
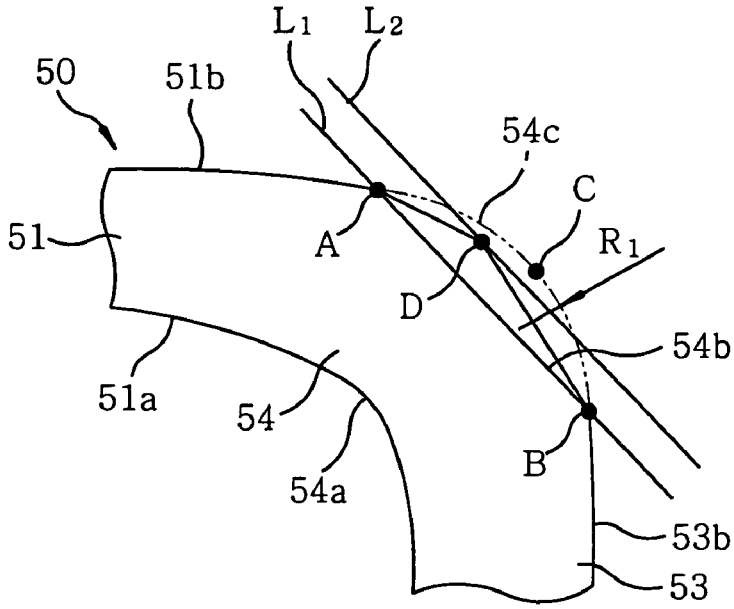
FIG. 9 provides a drawing describing a method for forming an external blend round contour of a blend round portion of a flat panel for use in a cathode ray tube in accordance with a third preferred embodiment of the present invention.
Figure 10:
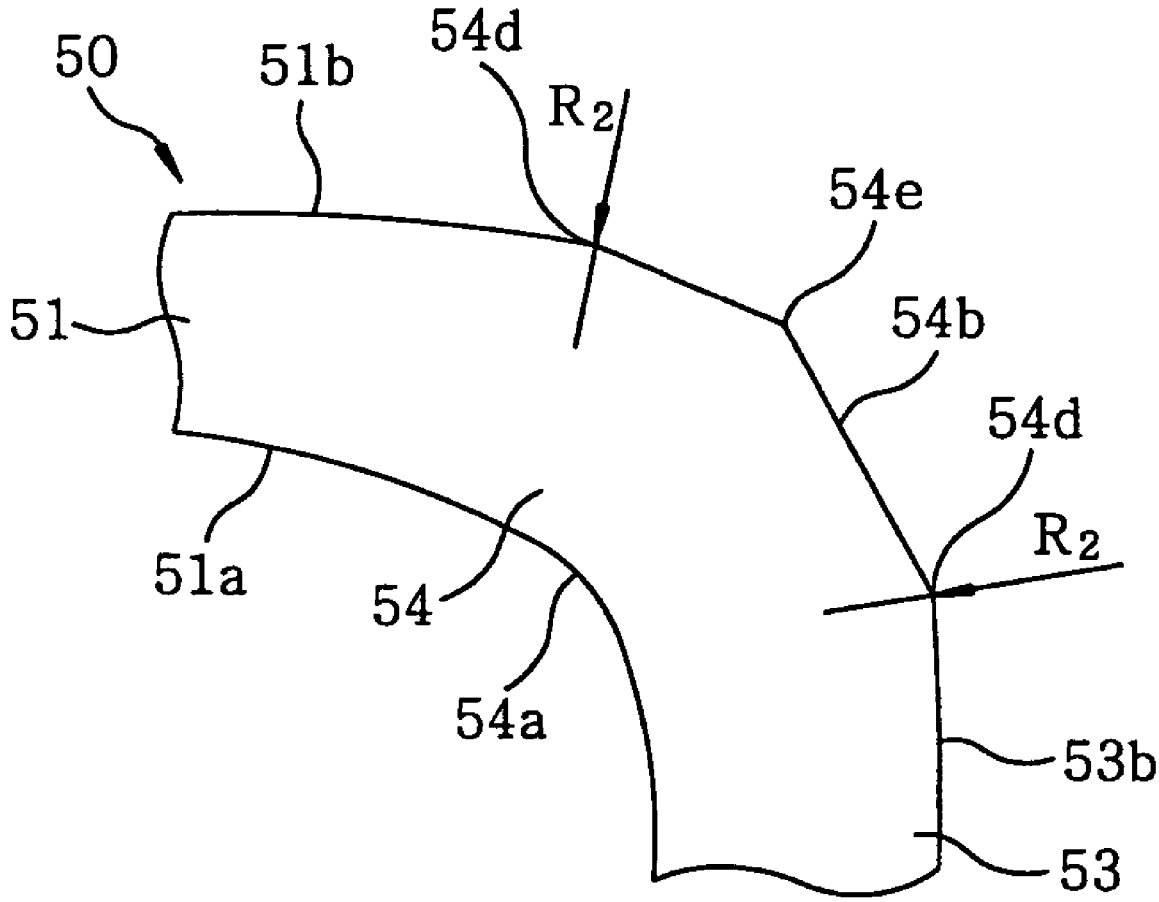
FIG. 10 depicts a partial cross sectional view of the flat panel for use in the cathode ray tube in accordance with the third preferred embodiment of the present invention.

FIGS. 9 and 10 describe a third preferred embodiment of the present invention in which an external blend round contour 54*b* is formed with more than one line segment. A flat panel 50 for use in a cathode ray tube in accordance with the third embodiment and a manufacturing method thereof will now be described. First, as in the first embodiment, the first and the second point A and B, the first and the second straight line $L_1$ and $L_2$ are obtained. The external blend round contour 54*b* is formed with two line segments connecting the first point A and a third point D on the second straight line $L_2$ and connecting the second point B and the third point D, respectively.

Moreover, as in the first embodiment, edge portions at the first and the second point A and B are preferably rounded to become rounds 54*d* each having a radius of curvature equal to or greater than 1 mm. In addition, it is preferred that an edge portion created by the two line segments is rounded to become a round 54*e* having a radius of curvature equal to or greater than 1 mm.

Furthermore, the external blend round contour 54*b* can be formed with at least one curve or at least two line segments connecting the first and the third point A and D and at least one curve or at least two line segments connecting the second and the third point B and D. Moreover, the external blend round contour 54*b* may be formed with a combination of curves and line segments.

The flat panel in accordance with the present invention described above is designed to have a blend round portion whose external blend round contour is formed more inside than that of the conventional flat panel. Therefore, the weight of the flat panel can be reduced. Particularly, since the external blend round contour is formed such that its conic section has a characteristic value ranging from 0.44 to 0.5, the weight reduction of the flat panel can be effectively achieved while, at the same time, satisfying the IEC standard for implosion resistance and guaranteeing the formability in press-forming.

Furthermore, since an edge portion created by the external blend round contour and the external contour of the faceplate portion and an edge portion created by the external blend round contour and the external contour of the skirt portion are rounded to become rounds each having a radius of curvature equal to or greater than 1 mm, the probability of breakage of the panel due to the stress concentration can be greatly reduced.

Moreover, since the locations of the point where the external blend round contour meets the external contour of the faceplate portion and the point where the external blend round contour meets the external contour of the skirt portion can be set at identical locations of those of the conventional flat panel, a conventional installation area for the implosion-proof band is still available in manufacturing a cathode ray tube even though the external blend round contour differs from that of the conventional flat panel, and, further, a conventional casing can be still used in manufacturing TV sets or monitors.

While the invention has been shown and described for the preferred embodiment of the present invention, it will be understood by those skilled in the art that various changes and modifications may be made without departing from the sprit and scope of the invention as defined in the following claims.

What is claimed is:

1. A flat panel for use in a cathode ray tube, comprising:

a faceplate portion for displaying images;

a skirt portion extended backward from a perimeter of the faceplate portion; and a blend round portion joining the faceplate portion with the skirt portion, wherein, looking at a cross section of the panel, a point formed by an external contour of the faceplate portion and an external blend round contour of the blend round portion is defined as a first point and a point formed by an external contour of the skirt portion and the external blend round contour of the blend round portion is defined as a second point, wherein the external contour of the blend round portion is a line segment whose two opposite end points coincide with the first and the second point.

2. The flat panel of claim 1, wherein edge portions at the first and the second point are rounded to become curves.

3. The flat panel of claim 2, wherein each of the curves obtained by rounding the edge portions at the first and the second point has a radius of curvature equal to or greater than 1 mm.

4. A flat panel for using in a cathode ray tube, comprising:

a faceplate portion for displaying images;

a skirt portion extending backward from a perimeter of the faceplate portion; and a blend round portion joining the faceplate portion with the skirt portion, wherein, in a cross section of the panel, a point formed by an external contour of the faceplate portion and an external contour of the blend round portion is defined as a first point and a point formed by an external contour of the skirt portion and the external contour of the blend round portion is defined as a second point, wherein the external is formed with at least two line segments, and wherein one end point of a first line segment of the line segments coincides with the first point and one end point of a second line segment of the line segment coincides with the second point, the first line segment being adjacent to the faceplate portion and the second line segment being adjacent to the skirt portion.

5. The flat panel of claim 4, wherein one or more edge portions created by the line segments are rounded to become one or more curves, each curve having a radius of curvature equal to or greater than 1 mm.

6. The flat panel of claim 4, wherein edge portions at the first and the second point are rounded to become curves.

7. The flat panel of claim 6, wherein each of the curves obtained by rounding the edge portions at the first and the second point has a radius of curvature equal to or greater than 1 mm.

* * * * *